US006266870B1

(12) United States Patent
Wollermann et al.

(10) Patent No.: US 6,266,870 B1
(45) Date of Patent: Jul. 31, 2001

(54) WIRE POSITIONING MECHANISM FOR A TERMINAL ATTACHING APPARATUS

(75) Inventors: Kenneth A. Wollermann, Mukwonago; John H. Olsen, II, Waukesha, both of WI (US)

(73) Assignee: Autos Engineering Co., Waukesha, WI (US)

( * ) Notice: Subject to any disclaimer, the term of this patent is extended or adjusted under 35 U.S.C. 154(b) by 0 days.

(21) Appl. No.: 09/396,916

(22) Filed: Sep. 15, 1999

(51) Int. Cl.[7] ..... H01R 43/04

(52) U.S. Cl. ..... 29/753; 29/564.4; 29/755; 29/857; 81/9.51

(58) Field of Search ..... 29/564.4, 749, 29/755, 757; 81/9.51

(56) References Cited

U.S. PATENT DOCUMENTS 4,713,880 12/1987 Dusel et al. .
5,109,590 * 5/1992 Endres ..... 29/564.4

* cited by examiner

*Primary Examiner*—Lee Young
*Assistant Examiner*—Rick Kiltae Chang
(74) *Attorney, Agent, or Firm*—Andrus, Sceales, Starke & Sawall, LLP

(57) ABSTRACT

The invention is directed to a wire cutting and stripping and terminal attaching apparatus and, in particular to an improved wire positioning mechanism for positioning the stripped end of an insulated wire in an open barrel terminal. After the insulated wire is cut and a slug of insulation is removed from the end of the wire, a gripper rotates the wire so that the bare or stripped end of the wire is located above an open barrel terminal supported on a lower die of a terminal attaching unit. An upper die is movable on the terminal attaching unit in a direction toward and away from the lower die to crimp the terminal on the stripped end of the wire. The wire positioning mechanism includes a positioning member which is mounted on the upper die and arranged to contact the gripper and push the stripped end of the wire downwardly into the open barrel terminal before the upper die operates to crimp the terminal. A power operated mechanism, such as a fluid cylinder, is connected to the wire positioning member and can move the wire positioning member to an inoperative position when the terminal attaching unit is employed to attach close barrel terminals.

11 Claims, 4 Drawing Sheets

FIG. 7
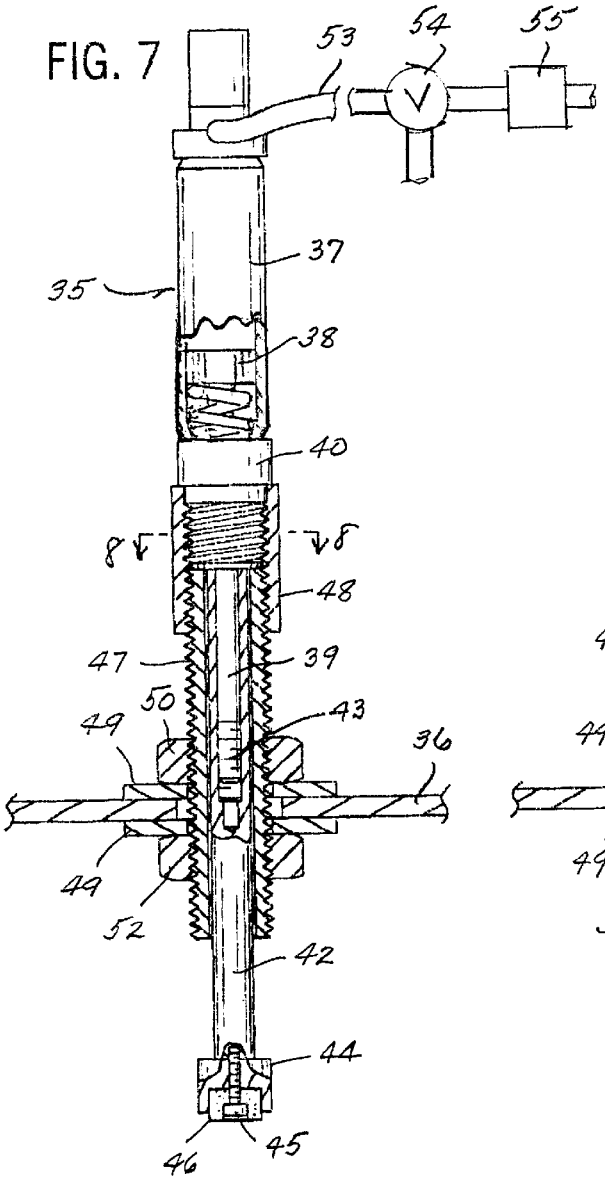
FIG 9
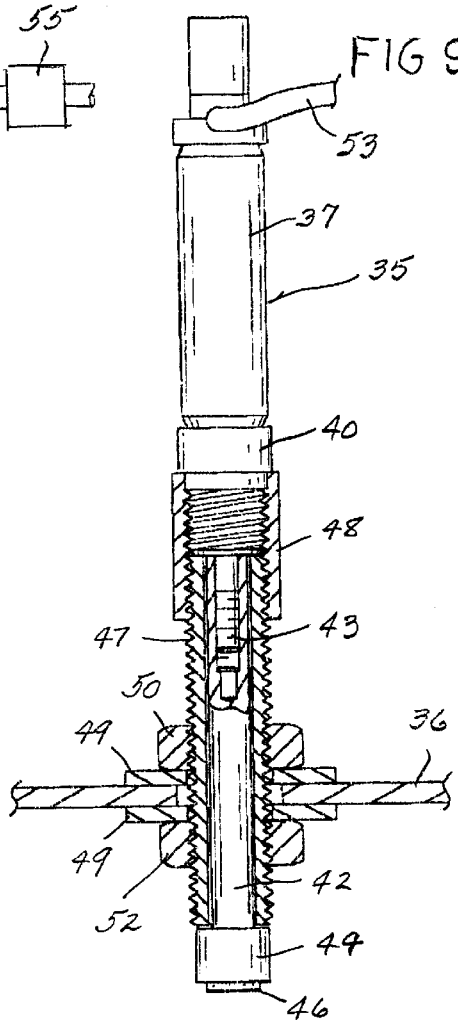
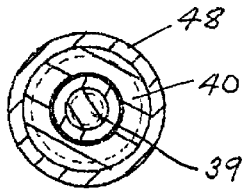
FIG. 8
FIG. 6
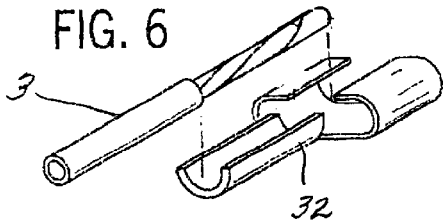

WIRE POSITIONING MECHANISM FOR A TERMINAL ATTACHING APPARATUS

BACKGROUND OF THE INVENTION

The conventional wire cutting and stripping and terminal attaching apparatus acts to automatically cut an insulated wire into predetermined lengths, strip the insulation from the ends of the wire and the cut length and apply an electrical terminal to one or both of the stripped ends of the wire and the cut length.

The typical wire cutting and stripping apparatus includes a cutting and stripping unit composed of a pair of cooperating cutting blades bordered on each side by a pair of stripping blades. The insulated wire is fed axially by a feeding unit to the cutting and stripping unit and on operation of the cutting and stripping unit, the cutting blades act to sever the wire and provide a cut length, while the stripping blades cut the insulation on either side of the severed end. Grippers then grip the wire, as well as the cut length, and move the wire and cut length axially in opposite directions to strip a slug of insulation from the end of the wire, as well as from the corresponding end of the cut length.

In the conventional unit, the grippers then rotate or pivot horizontally to position the stripped end of the wire, as well as the stripped end of the cut length, in corresponding terminal attaching units, where an electrical terminal is applied to the stripped end of the wire and to the cut length. After attachment of the terminals, the grippers pivot back to their original position and the cut length is then discharged from the machine, while the wire is advanced axially to repeat the cutting and stripping operation.

There are two basic types of terminals that are applied to the stripped end of the wire. One being an open barrel terminal, and the other a closed barrel terminal. An open barrel terminal is generally U-shaped in cross section and the stripped end of the wire is moved downwardly into the open barrel for crimping. A closed barrel terminal is generally cylindrical in configuration and the stripped end of the wire is moved axially into the closed barrel for crimping.

When using open barrel terminals, the gripper positions the stripped end of the wire slightly above the terminal which is supported on an anvil or lower die member. An upper die member is movable toward and away from the anvil and acts to crimp the terminal on the stripped wire end. Because the wire is positioned above the terminal by the gripper, a wire positioning member, sometimes referred to as a "tonker", is mounted on the upper die member and is arranged to contact the gripper and push the wire downwardly into the open barrel terminal before the upper die member acts to crimp the terminal on the stripped wire end.

In the past, the typical wire positioning member has taken the form of a fixed, or a resilient member such as a spring, that is mounted on the upper die member in position to engage the gripper and move the wire downwardly as the upper die member is lowered.

It is frequently necessary to change the wire processing program from open barrel terminals to closed barrel terminals. The grippers can be programmed to change movement to conform to open and closed barrel termination, but when changing from open barrel termination to closed barrel termination, it is necessary to remove the wire positioning member from the upper die member. The wire positioning member, if left in position on the upper die member during closed barrel termination, would engage the gripper and correspondingly move the wire held by the gripper out of axial alignment with the closed barrel terminal. Accordingly, it has been necessary to manually remove the wire positioning member from the upper die member when changing from open barrel to closed barrel termination. This not only requires the labor and downtime for removal of the wire positioning member, but also requires that the wire positioning member be recalibrated when it is reattached to the machine for open barrel termination.

SUMMARY OF THE INVENTION

The invention is directed to a wire cutting, stripping and terminal attaching apparatus and, in particular, to an improved wire positioning mechanism associated with the terminal attaching unit. The terminal attaching unit includes a lower die or anvil which supports a terminal, such as an open barrel terminal. A pair of grippers are located on either side of the wire cutting and stripping unit and after the insulated wire is cut, and slugs of insulation are cut and stripped from the end of the wire, as well as from the end of the cut length, the grippers each swing horizontally to position both the bare end of the wire, as well as the cut length, above an open barrel terminal which is supported on the lower die of the respective terminal attaching unit.

An upper die member is movable on each terminal attaching unit toward and away from the lower die to crimp the terminal on the stripped end of the wire. Mounted on the upper die member, is a wire positioning member which is constructed and arranged to contact the respective gripper and push the stripped end of the wire downwardly into the open barrel terminal before the upper die member operates to crimp the terminal.

In accordance with the invention, the wire positioning member is movable relative to the upper die member between an upper inoperative position and a lower operative position by a power operated mechanism, preferably a pneumatic cylinder. During open barrel termination, the wire positioning member is in the lower operative position where it will contact the gripper and move the wire downwardly into the open barrel terminal. For closed barrel termination, the air pressure in the cylinder is released, enabling the wire positioning member to move to the inoperative position, preferably by spring action, so that the wire positioning member will then be in a position where it will not interfere with the gripper or wire during the closed barrel termination.

With the invention, the wire positioning member will be automatically moved between an operative and inoperative position depending on the type of terminal that is selected. Thus, it is not necessary to manually remove the wire positioning member from the upper die when shifting from open barrel termination to closed barrel termination. This substantially reduces the labor involved when changing between open barrel and closed barrel termination, and correspondingly decreases the downtime of the machine. Further, it is not necessary to recalibrate the wire positioning member when it is re-attached to the machine when changing from closed barrel to open barrel termination, as in the past.

The use of a pneumatic cylinder for operating the wire positioning member provides a resilient force to take up over-travel during the crimping operation. The force provided by the pneumatic cylinder is constant and controllable as opposed to a variable spring force provided by a compression spring.

BRIEF DESCRIPTION OF THE DRAWINGS

The drawings illustrate the best mode presently contemplated of carrying out the invention.

In the drawings:

FIG. 6 is a perspective view of an insulated wire and an open barrel terminal with the stripped end of the wire being shown in position above the terminal;

FIG. 7 is a side elevation with parts broken away in section of the wire positioning member;

FIG. 8 is a section taken along line 8—8 of FIG. 7; and

FIG. 9 is a view similar to FIG. 7 showing the wire positioning member in the upper inoperative position.

DESCRIPTION OF THE PREFERRED EMBODIMENT

Figure 1:
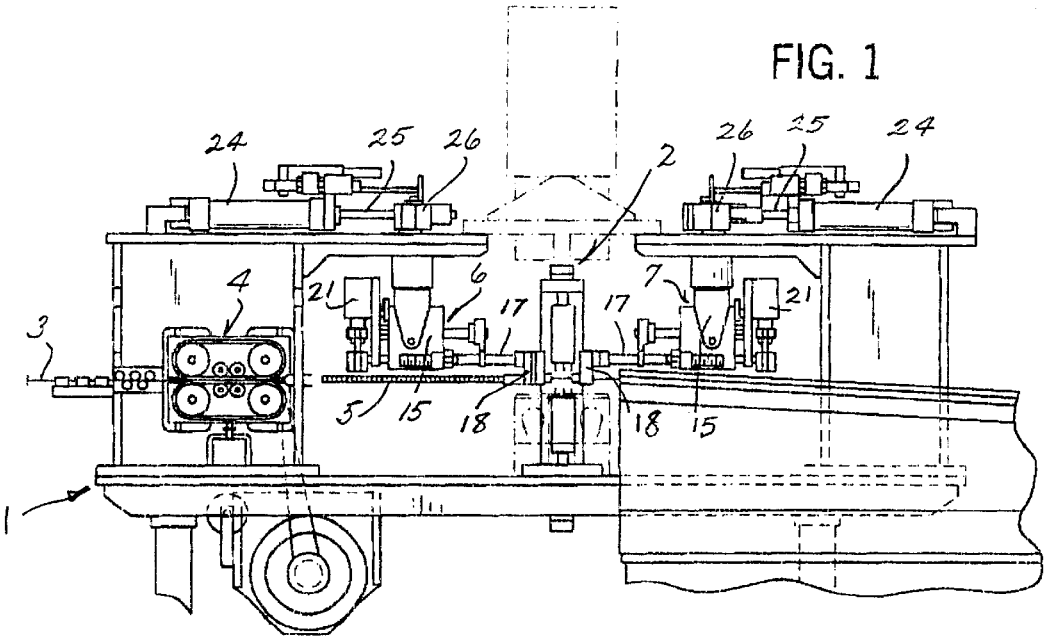
FIG. 1 is a side elevation of a typical wire cutting and stripping and terminal attaching apparatus incorporating the invention.
Figure 2:
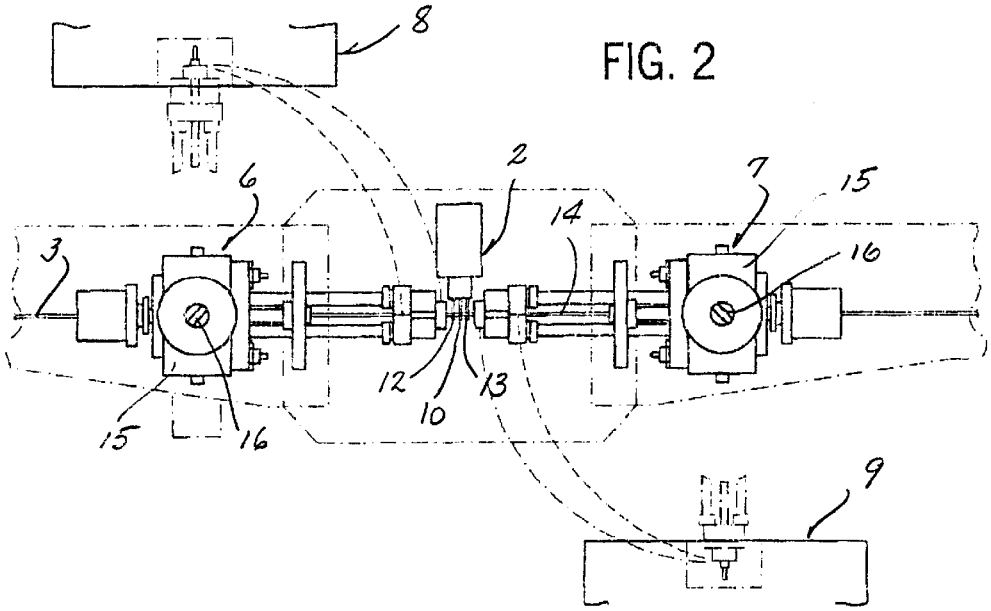
FIG. 2 is a top view of the apparatus shown in FIG. 1.
Figure 3:
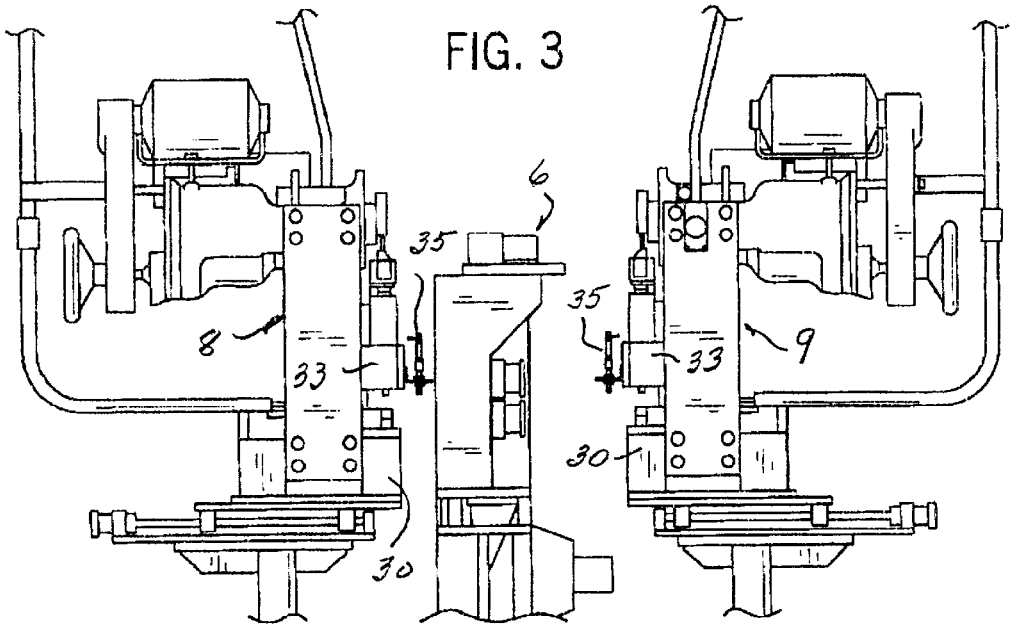
FIG. 3 is an end view of the apparatus of the apparatus of FIG. 1.

FIGS. 1–4 show an apparatus for cutting and stripping insulated wire and attaching terminals to one or both stripped ends of the wire. The apparatus, in general, includes a frame 1 or structural support and a cutting and stripping unit 2 is mounted centrally on the frame. An insulated wire 3 is fed by a feed unit 4 through a flexible tube 5 to the cutting and stripping unit 2. Grippers 6 and 7 are positioned upstream and downstream respectively, of the cutting and stripping unit 2. Terminal attaching units 8 and 9 are located laterally on either side of the cutting and stripping unit. Terminal attaching units 8 and 9 are not shown in FIG. 1, but are illustrated in FIGS. 2 and 3.

In operation, the insulated wire 3 is fed by feed unit 4 through tube 5 to the cutting and stripping unit 2 which includes a pair of central cutting blades 10, and two pair of stripping blades 12 and 13, which are located on either side of the cutting blades. With a predetermined length of wire positioned in the cutting and stripping unit 2, the cutting and stripping blades are moved toward each other causing the cutter blades 10 to sever the wire and provide a cut length 14, while the stripping blades 12 and 13 will cut the insulation. Gripper 6 is then actuated to grip the wire 3 while gripper 7 is simultaneously actuated to grip the cut length 14. Gripper units 6 and 7 are then moved axially in opposite directions causing a slug of insulation to be stripped from the end of wire 3, and from the end of cut length 14. Both grippers 6 and 7 then swing outwardly in opposite directions to cause gripper 6 to deliver the wire 3 to the terminal attaching unit 8, while the gripper 7 delivers the cut length 14 to the terminal attaching unit 9 where terminals are applied to the stripped end of the wire 3, as well as to the stripped end of cut length 14.

Grippers 6 and 7 then swing back to their original position and release the wire 3 and the cut length 14. The cut length having attached terminals is then collected in a bin, or other collection site, not shown, and the wire 3 is then advanced through the cutting and stripping unit to begin a second cycle.

The feed unit 4, the cutting and stripping unit 2, the grippers 6 and 7, as well as the terminal attaching units 8 and 9, can be constructed as shown in U.S. Pat. No. 4,713,880, which is incorporated herein by reference.

Cutting and stripping unit 2 is of conventional construction, and the cutting blades 10 are arranged to pass by each other closely so as to shear the wire in guillotine fashion. The cutting blades 10, as well as stripping blades 12 and 13, can be operated by fluid cylinders, as described in U.S. Pat. No. 4,713,880. Stripping blades 12 and 13 which are spaced axially from the cutting blades 10 are arranged to merely cut the insulation surrounding the wire without damaging the metal wire itself.

Grippers 6 and 7, located on either side of the cutting stripping unit, are identical in construction and can be constructed as described in U.S. Pat. No. 4,713,880. Hence the description will be directed to gripper 6, with the understanding that the same description would also apply to the downstream gripper 7.

Gripper 6 includes a central body 15 which is supported by a vertical shaft 16 that is journaled in frame 1. A pair of generally horizontal parallel slide rods 17 are mounted for sliding movement in the lower portion of body 15, and the outer ends of rod 17 carry a pair of gripper jaws 18, which can be pivoted toward each other to grip the wire located between the jaws, in the manner as set forth in the aforementioned patent. To pivot jaws 18 between an open and closed position, the opposite ends of rods 17 are connected through a linkage 19 to the piston rod 20 of cylinder 21. Operation of cylinder 21 will operate through linkage 19 to rotate rods 17 causing jaws 18 to move from the open to closed position.

Gripper jaws 18 can also be moved from a retracted to an extended position, as described in the aforementioned patent. In this regard, body 15 houses a cylinder, not shown, and a piston is movable in the cylinder and carries a horizontal piston rod 22. One end of rod 22 is connected through a bracket 23 to slide rods 17. With this construction, linear movement of piston rod 22 will move the slide rods 17, as well as jaws 18, between a retracted position and an extended position.

As described in U.S. Pat. No. 4,713,880, grippers 6 and 7 can be pivoted or swung horizontally to position the stripped end of wire 3 at the terminal attaching unit 8 and simultaneously position the bare or stripped end of cut length 14 at the terminal attaching unit 9. To provide this pivotal movement for the gripper 6, a cylinder 24, as seen in FIG. 1, is mounted horizontally on frame 1 and the piston rod 25 of cylinder 24 is connected through a pivot arm 26 to vertical shaft 16. Through operation of cylinder 24, the gripper can be swung laterally outward, as shown in FIG. 2, to position the wire 3 at the terminal attaching unit 8. Similarly, the gripper 7 can be pivoted laterally in the opposite direction to position the stripped end of the cut length 14 at the terminal attaching unit 9.

In addition, body 15 is mounted for limited pivotal movement relative to frame 1 about axis 27 by virtue of the pivotal connection between body 15 and yoke 29 supported by shaft 16.

Terminal attaching units 8 and 9 are identical in construction and operation of the units is similar to that in U.S. Pat. No. 4,713,880. Each terminal attaching unit includes a press 30 having a lower die or anvil 31 on which a terminal 32 is supported. FIG. 6 shows an open barrel terminal 32 which is generally U-shaped in cross section. The apparatus of the invention can also be employed to attach closed barrel terminals which are generally cylindrical in cross section to the stripped end of the wire. In a conventional manner, the terminals 32 are attached together in a chain-like configuration and fed from a reel, or other source, to the terminal attaching unit.

The press 30 of the terminal attaching unit, also includes an upper head 33 that is movable in a direction toward and away from anvil 32 by a conventional mechanical or hydraulic mechanism. Head 33 carries an upper die member 34 which is adapted to engage and crimp the terminal on the stripped end of the wire.

In accordance with the invention, a wire positioning mechanism 35 is connected to upper head 33 of the terminal attaching unit through bracket 36 and is movable therewith.

As best shown in FIGS. 7 and 8, wire positioning member mechanism 35 includes a pneumatic cylinder 37 and a piston 38 is slidable within the cylinder 37 and carries a rod 39 which projects downwardly through the lower head or nose 40 of the cylinder. An extension rod 42 is connected to the lower end of piston rod 33 by a stud 43, and the lower end of extension rod 42 carries a cap 44 that is attached to rod 42 via a screw 45. The lower end of cap 44 is recessed and contains a resilient cushion 46.

An externally threaded sleeve 47 is freely mounted for sliding movement on piston rod 39 and extension rod 42, and a nut 48 is threaded on sleeve 47, as well as on nose 40 of cylinder 37, to connect the sleeve to the cylinder.

To mount the wire positioning mechanism 35 on bracket 36, a pair of washers 49 are located on either side of the bracket and nuts 50 and 52 are threaded on sleeve 47 and are located above and below the bracket. Through this connection, the wire positioning member can be adjusted vertically relative to bracket 36 and head 32 of the terminal attaching unit.

Air is supplied to the upper end of cylinder 37 through a line 53, and a suitable valve 54 is located in line 53 and serves to alternately connected the cylinder with a source of air under regulated pressure or the atmosphere. The pressure of the air supplied through line 53 can be regulated by a conventional pressure regulator 55. By supplying air through line 53 to the upper end of the cylinder, the piston rod will be moved downwardly to position the cap 44 in an operative position, as shown in FIG. 7. The cap 44 is positioned so that it will contact the gripper 6 and pivot the gripper downwardly about axis 27, thus moving the wire 3 carried by the gripper downwardly to position the stripped end of the wire in the open barrel terminal. The position of the cap is correlated with movement of the upper head 33 and die 34, so that the wire 3 will be pushed into the terminal 32 before the upper die 34 engages the terminal to crimp the same. After the crimping operation, the upper head 33 and die 34 will move upwardly and the wire positioning member 35 will correspondingly move upwardly out of engagement with the gripper 6. The air pressure in cylinder 37 provides a resilient force which will take up the override in the movement of the wire positioning member. Further, the pneumatic force is constant and controllable, which is an advantage over the use of a resilient mechanism, such as a coil spring.

Figure 4:
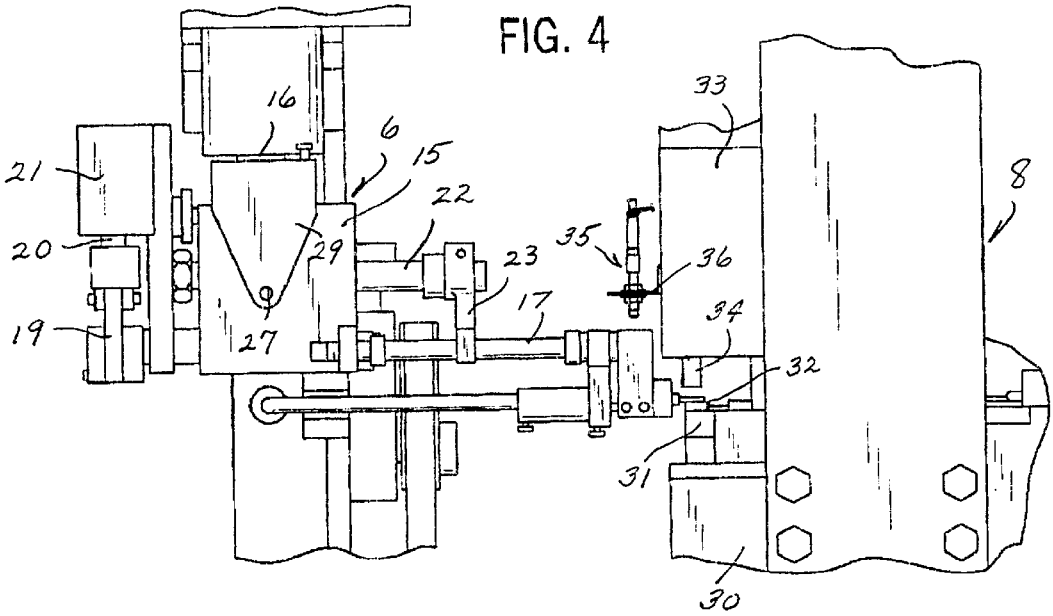
FIG. 4 a side elevation showing a gripper and a terminal attaching unit with the wire positioning member shown in the upper inoperative position.
Figure 5:
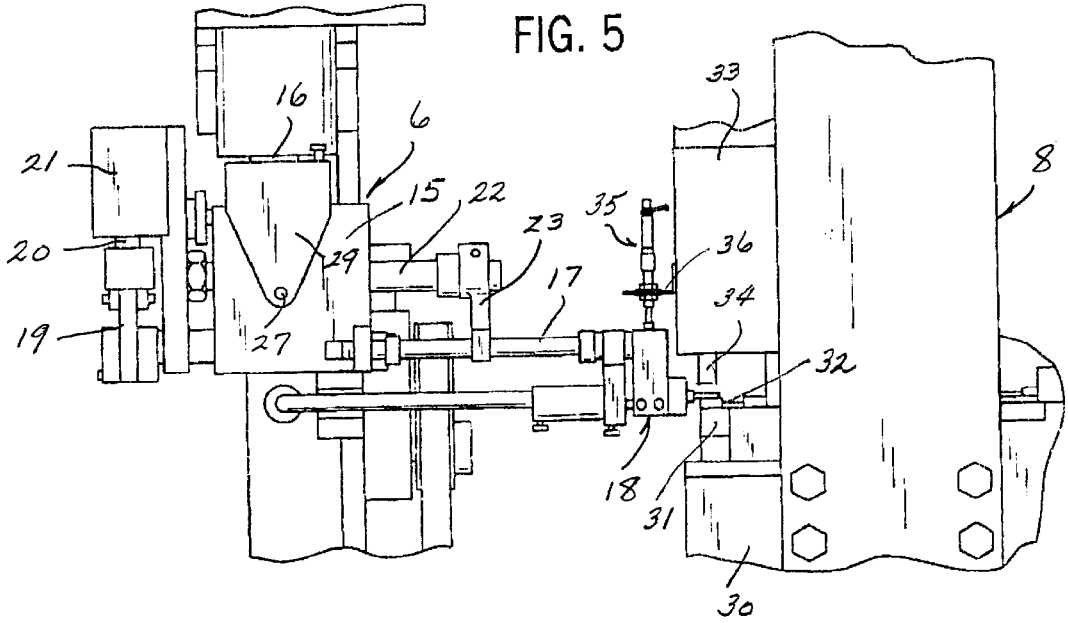
FIG. 5 is a view similar to FIG. 4 showing the upper die member in the crimping position and the wire positioning member in the lower operative position and in engagement with the gripper.

If the terminal attaching unit is to be switched to a closed barrel termination, the wire positioning member is not required, and accordingly, the air pressure in cylinder 37 is automatically released, preferably by computerized programming, and the piston rod 39 and extension rod 42 will be moved upwardly through a spring 55, which is located in cylinder 37 and bears against the undersurface of piston 38, thus moving the cap 44 to an inoperative position, as shown in FIG. 4, where it will not engage the gripper 6 when the head 33 and upper die 34 of the terminal attaching unit is lowered. Thus, with the invention, the wire positioning member will be automatically moved between an operative position and inoperative position depending on the type of terminal selected. It is not necessary to manually remove the wire positioning member from the terminal attaching unit when switching from open barrel termination to closed barrel termination.

When attaching open barrel terminals, the gripper jaws 18 will be moved to the extended position as the gripper 6 is rotated or swung horizontally in order to position the stripped end of the wire 3 over the open barrel terminal 32. On the other hand, if closed barrel terminals are to be employed, the gripper jaws 18 are not extended as the gripper is swung outwardly, but rather the jaws are held in the retracted position and after the swinging action is complete, the gripper is then extended, sliding the stripped wire end into the closed barrel terminal.

Various alternatives and embodiments are contemplated as being within the scope of the following claims particularly pointing out and distinctly claiming the subject matter regarded as the invention.

What is claimed is:

1. In an apparatus for attaching a terminal to a wire, a first die member to support an open barrel terminal, gripper means for positioning an end of a wire in parallel spaced relation to the terminal supported on said first member, a second die member movable relative to the first die member and constructed and arranged to crimp the terminal on the end of said wire, and wire positioning means operably connected to the second die member and constructed and arranged to contact said gripper means and push said wire into the open barrel terminal before said second die member crimps the terminal on said wire, said wire positioning means comprises a wire positioning member mounted for movement on said second die member between a first operable position where said wire positioning member will contact said gripper means and push said wire into said terminal and a second inoperative position where said wire positioning member is out of contact with said gripper means when second die member crimps said terminal on the end of the wire, and power operated means for moving said wire positioning member between said first and second positions.

2. The apparatus of claim 1, wherein said power operated means comprises a pneumatic cylinder unit connecting said upper die member and said wire positioning member.

3. The apparatus of claim 2, wherein said pneumatic cylinder unit comprises a cylinder and piston means slidable within the cylinder and operably connected to said wire positioning member, and means for supplying air to said cylinder to thereby move the wire positioning member from the inoperative position to the operative position.

4. The apparatus of claim 3, further including means for adjusting a pressure of the air supplied to said cylinder.

5. The apparatus of claim 4, further including adjusting means separate from said power operated means for adjusting a vertical position of the wire positioning member relative to the second die member.

6. The apparatus of claim 3, further including means for releasing air pressure in said cylinder, and biasing means for moving said wire positioning member from the operative position to the inoperative position.

7. The apparatus of claim 1, further including adjusting means separate from said power operated means for adjusting a position of said wire positioning member relative to said second die member.

8. In an apparatus for attaching a terminal to a wire, a first die member to support an open barrel terminal, gripper means for positioning an end of a wire in parallel spaced relation to the terminal supported on said first die member, a second die member movable relative to the first die member and constructed and arranged to crimp the terminal on the end of said wire, and wire positioning means operably connected to the second die member and constructed and arranged to contact said gripper means and push said wire into the open barrel terminal before said second die member crimps the terminal on said wire, said wire positioning means comprises a wire positioning member mounted for movement on said second die member between a first operable position where said wire positioning member will contact said gripper means and push said wire into said terminal and a second inoperative position where said wire positioning member will not contact said gripper means as said second die member moves toward said first die member, and means for moving said wire positioning member between said first and second positions.

9. The apparatus of claim 8, wherein said power operated means for moving said wire positioning member between said first and second positions comprises a fluid cylinder unit operably connected between said second die member and said wire positioning member.

10. The apparatus of claim 9, wherein said fluid cylinder unit comprises a cylinder and piston means slidable in said cylinder and operably connected to said wire positioning member, and means to supply a compressible fluid to said cylinder to thereby move said wire positioning member to the operative position.

11. The apparatus of claim 8, further including adjusting means for adjusting a position of said wire positioning member relative to said second die member.

* * * * *

UNITED STATES PATENT AND TRADEMARK OFFICE

CERTIFICATE OF CORRECTION

PATENT NO. : 6,266,870 B1
DATED : July 31, 2001
INVENTOR(S) : Kenneth A. Wollermann and John H. Olsen, II It is certified that error appears in the above-identified patent and that said Letters Patent is hereby corrected as shown below:

Title page,
Item [73], Assignee, delete "Autos Engineering Co." and substitute therefor -- Artos Engineering Co. --

Column 6, claim 1,
Line 3, after "first" insert -- die --

Signed and Sealed this

Sixteenth Day of April, 2002

*Attest:*

*Attesting Officer*

JAMES E. ROGAN
*Director of the United States Patent and Trademark Office*